US005222583A

United States Patent [19]

Bergmann et al.

[11] Patent Number: 5,222,583

[45] Date of Patent: Jun. 29, 1993

[54] METHOD OF MONITORING CHANGE DISPENSER OPERATION

[75] Inventors: Tjark Bergmann; Thorsten Wohlers; Klaus Meyer, all of Hamburg, Fed. Rep. of Germany

[73] Assignee: Th. Bergmann GmbH & Co., Bellingen, Fed. Rep. of Germany

[21] Appl. No.: 750,567

[22] Filed: Aug. 26, 1991

Related U.S. Application Data

[63] Continuation-in-part of Ser. No. 418,347, Oct. 6, 1989, abandoned.

[30] Foreign Application Priority Data

Oct. 6, 1988 [DE] Fed. Rep. of Germany ..... 3834019
Feb. 23, 1989 [DE] Fed. Rep. of Germany ... 8902145[U]
Jun. 29, 1989 [DE] Fed. Rep. of Germany ... 8907922[U]

[51] Int. Cl.[5] ..... G07F 7/04

[52] U.S. Cl. ..... 194/206; 194/217; 453/56

[58] Field of Search ..... 194/217, 206, 207; 453/16, 17, 56, 57, 32

[56] References Cited

U.S. PATENT DOCUMENTS 3,925,619 12/1975 Freethy ..... 194/216 X
4,335,809 6/1982 Wain ..... 194/239
4,342,384 8/1982 Fukase et al. ..... 453/56
4,611,205 9/1986 Eglise ..... 194/217 X
4,872,541 10/1989 Hayashi ..... 194/217

FOREIGN PATENT DOCUMENTS 0287049 10/1988 European Pat. Off. ..... 453/32
346254 12/1989 European Pat. Off. ..... 194/217
3247019 6/1984 Fed. Rep. of Germany ..... 453/17
3641806 6/1988 Fed. Rep. of Germany ..... 194/206
52-14493 2/1977 Japan ..... 453/56
53-21996 2/1978 Japan ..... 453/56
2181876 4/1987 United Kingdom ..... 194/206
2186412 8/1987 United Kingdom ..... 194/206

*Primary Examiner*—Michael S. Huppert
*Assistant Examiner*—William M. Hienz
*Attorney, Agent, or Firm*—Dominik, Stein, Saccocio, Reese, Colitz & Van Der Wall

[57] ABSTRACT

The invention relates to a method of cashing up and collecting money from coin-operated machines and an arrangement of coin-operated machines for carrying out the method. The coin-operated machines which are in association with a money changing machine to form a group. A counter is provided which registers the amounts of money arising, such as the value of coins inserted into gambling machines. Excess coins arising in the machines during play are first fed, unsorted, to the money changing machine, and when its set filling level is reached, are fed to a coin strongbox. It is possible to sort out and feed at least one preferred type of coin, such as a high value coin or a low value coin, to the money changing machine and to feed remaining excess coins unsorted to a coin strongbox. The value of coins being transferred by the coin sorting device is continuously added and stored separately from the coins to be paid out and to be fed into a coin strongbox of the change dispenser. The amount of the banknotes fed into the change dispenser and accumulated in the banknote collecting container is also being added and stored. The data with respect to the stored banknotes and coins are transferred by a radio equipment from the change dispenser to a control device, so that the value of the collections can be monitored, and so that the coin-operated machines can be cashed up as necessary.

11 Claims, 14 Drawing Sheets

Figure 1:
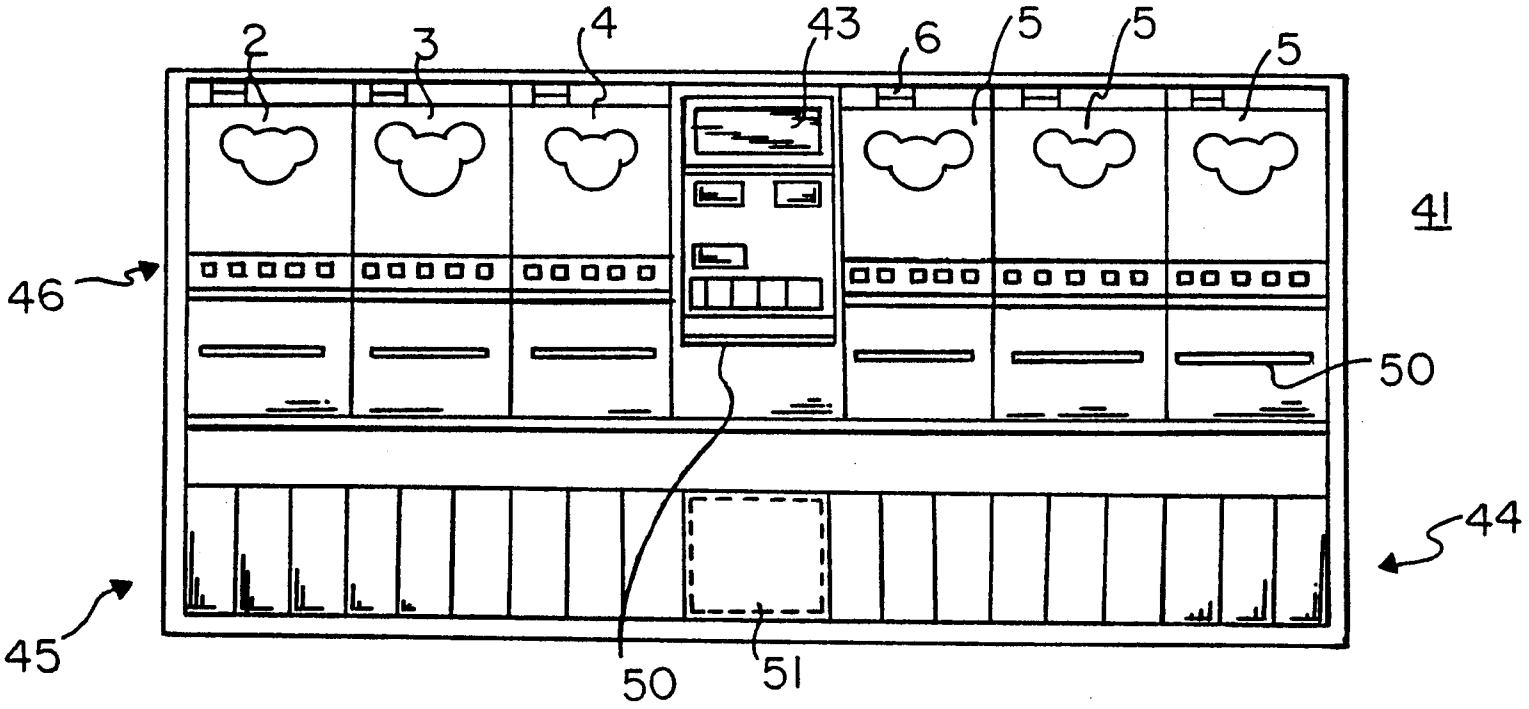

FIG. 2
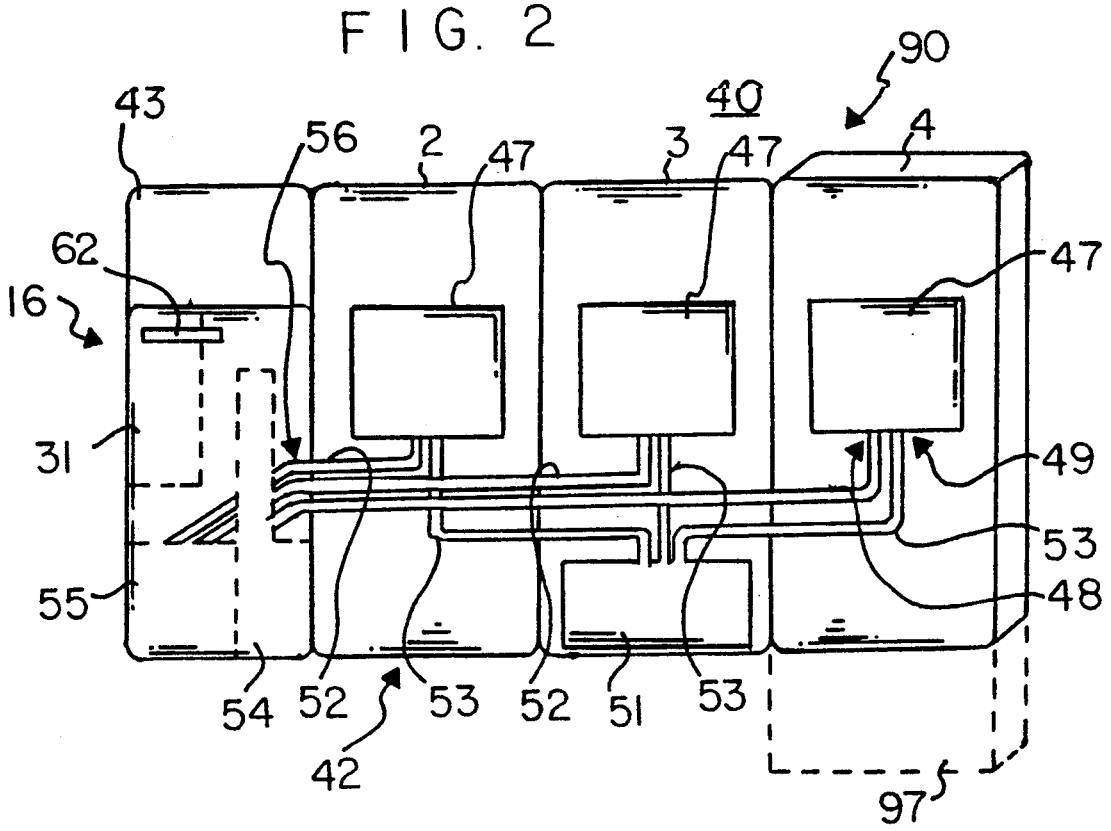
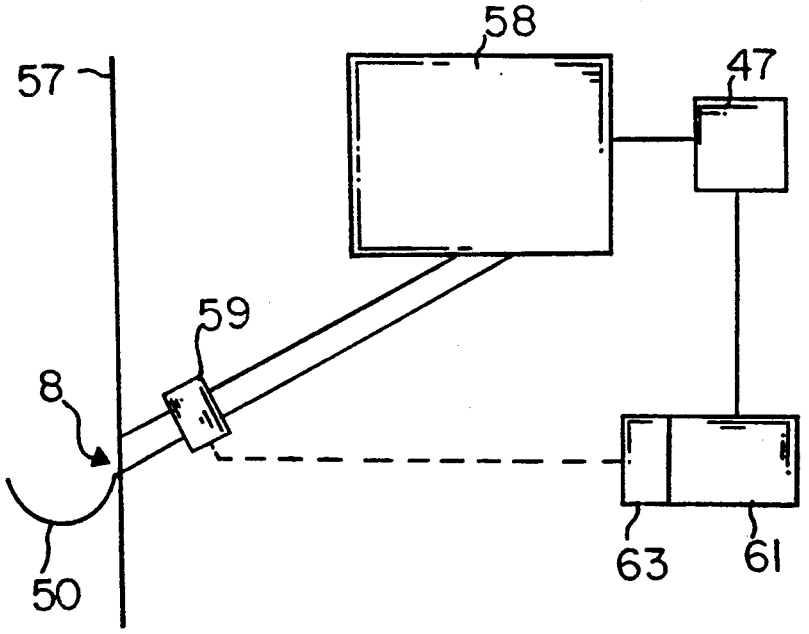
FIG. 3

FIG. 6
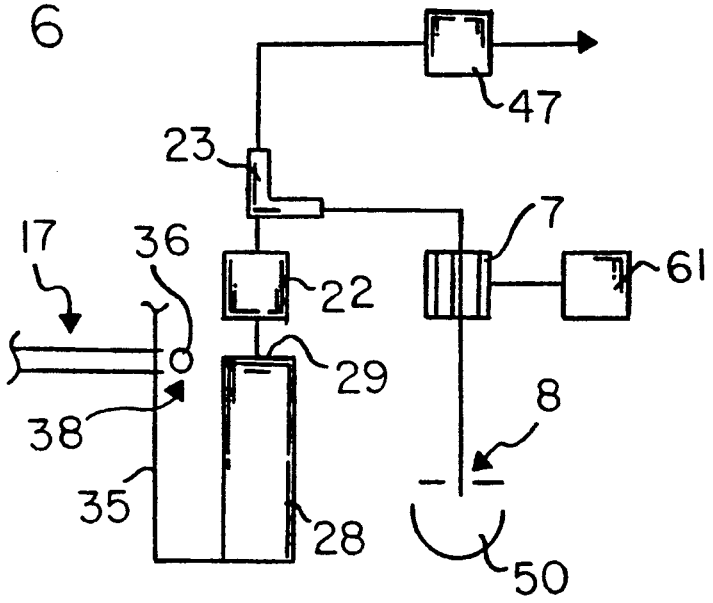
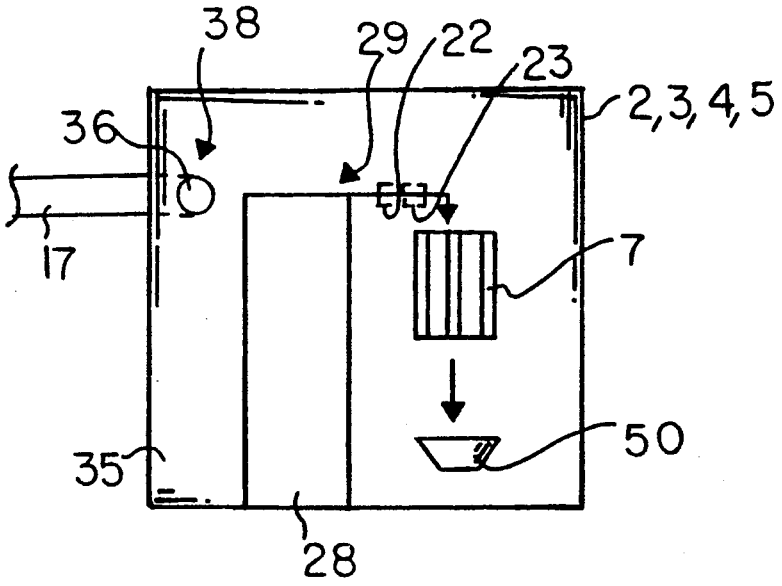
FIG. 7

FIG. 11
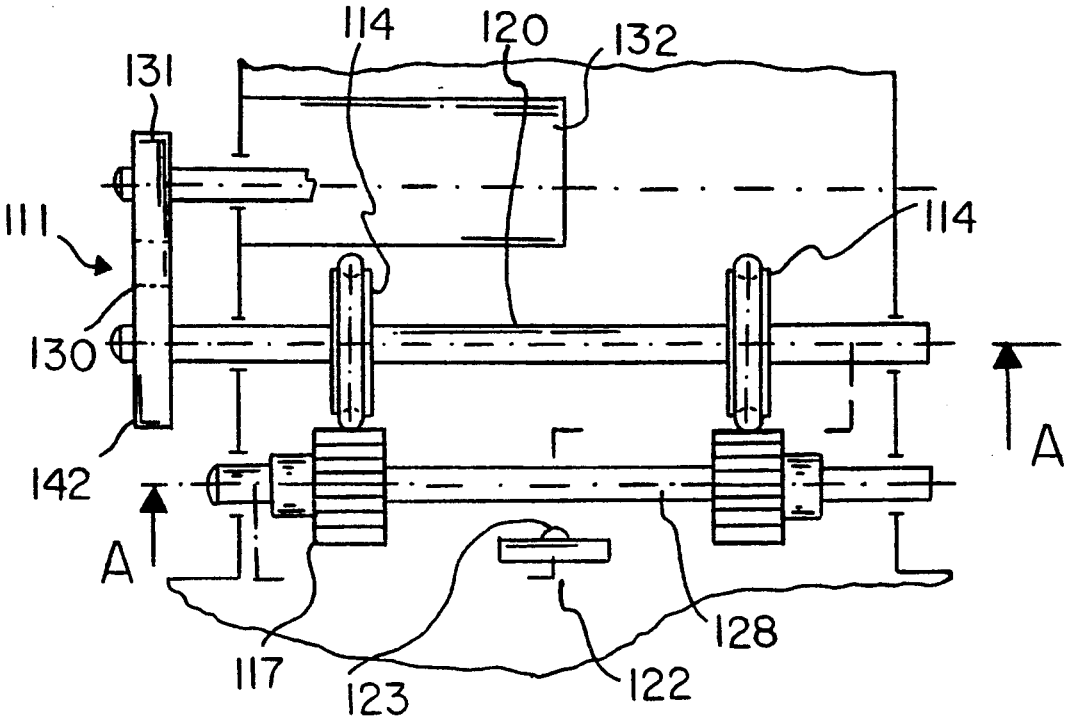
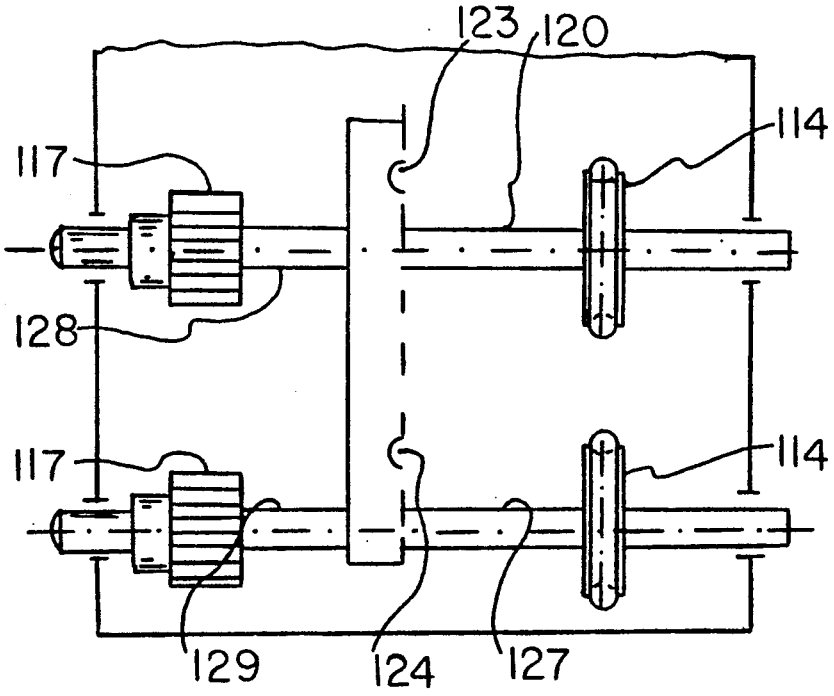
A-A
FIG. 12

METHOD OF MONITORING CHANGE DISPENSER OPERATION

This is a continuation-in-part of copending application(s) Ser. No. 07/418,347 filed on Oct. 6, 1989, now abandoned.

The invention relates to a method of monitoring, cashing up and collecting money from coin-operated machines like vending machines and gambling machines which are connected individually or in groups with a change dispenser, whereby excess coins in the vending or gambling machines are transferred back unsorted to the change dispenser in which the coins are fed to a payout tray by a coin sorting device in accordance with the banknote to be changed and an arrangement for carrying out the method.

Machines in gaming arcades, casinos and other machine sites have a typical money cycle: coins are required for operating the machines, but the customers frequently do not have sufficient amounts of small change, so that the operator always has to keep a supply of considerable amounts of change available. Secondly, the revenue from machines in the abovementioned establishments is in coin form only, which results in considerable amounts of coin takings and problems with respect to collecting money. While money is collected, the machines usually need to be opened, so that operation of the respective machine must be interrupted. Particularly trustworthy personnel are required for collecting money. There are also special security problems with respect to theft and breakins, particularly where the intervals between collecting money are relatively long, as well as the risk of hold-ups etc. during the money collection operation itself. Machines must always have a minimum coin reserve. So-called cashing up refers to the process in which amounts more than this reserve can be removed from the machines. Special devices, as described, for example, in German Patent Application P 3,604,212,91, are used for this purpose. Where a plurality of machines at one installation site need to be cashed up and have money collected, this is perceived to be extraordinarily inconvenient and laborious, and there is always the risk in connection with security and manipulation. It has proved to be advantageous, and meeting the wishes of the players, to combine several coin-operated machines to form a machine group, it then being possible for one player to play on the machines simultaneously. The amount of coins required for this must then be made available by the machine operator or a banknote changer. This is perceived to be unpleasant by the players, since it is necessary to leave the machines being played on and it is possible for third parties to observe the procurement of coins. Since players mostly prefer being able to pursue their gaming desire unobserved at the machine groups, it is necessary for the gaming establishments in the gaming arcades or casinos to provide room divisions by means of partition walls so that the individual machine groups are not located in one area of vision. Such partition walls require alterations in the building substance and can only be removed with considerable outlay if another room division is ever desired.

It is known by the British Patent No. 21 81 876 to connect gambling machines with a change dispenser. Banknotes are changed to coins by the change dispenser which are used for operating the gambling machines. The amount of coins which exceed the coin reserve of the machine is transferred by a conveying equipment into the change dispenser and introduced into coin stacking containers in accordance with the type of coins. By this it is possible to convey coins not required for winnings or change in a circuit. With such a device cashing up and collecting money is possible by withdrawal of surplus bank-notes and coins from the change dispenser. There is the disadvantage because each of the change dispensers have to be visited in order to draw up the dates. Especially in big casinos with many groups of gambling machines and charge dispensers or such groups in different casinos cashing up and monitoring is of large-scale and makes it impossible to get a survey about the actual status.

The object of the invention is to improve the above mentioned method and arrangement, by means of which, it is possible for the player to be supplied with coins simply and to a large extent anonymously, as well as facilitating money collection from the respective machines, whereby, for this purpose, a largely manipulation-proof, central, clear and meaningful system for monitoring, cashing up and collecting money is to be available.

According to the invention, the solution of the object with regard to the method is provided by the defining features of claim 1, and with regard to the arrangement by the defining features of claim 17. Advantageous embodiments of the invention are described in the dependent claims.

Exemplary embodiments of the invention are illustrated in the drawings, with reference to which the invention is described more fully below.

Figure 9:
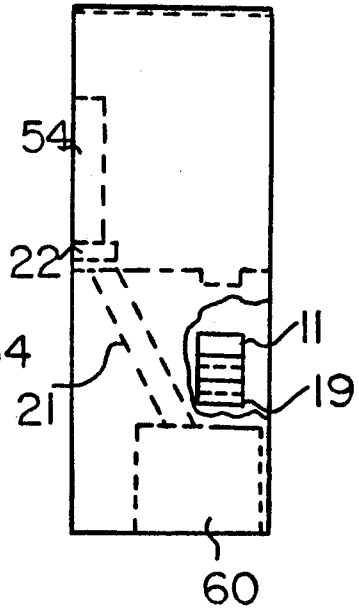
Figure 10:
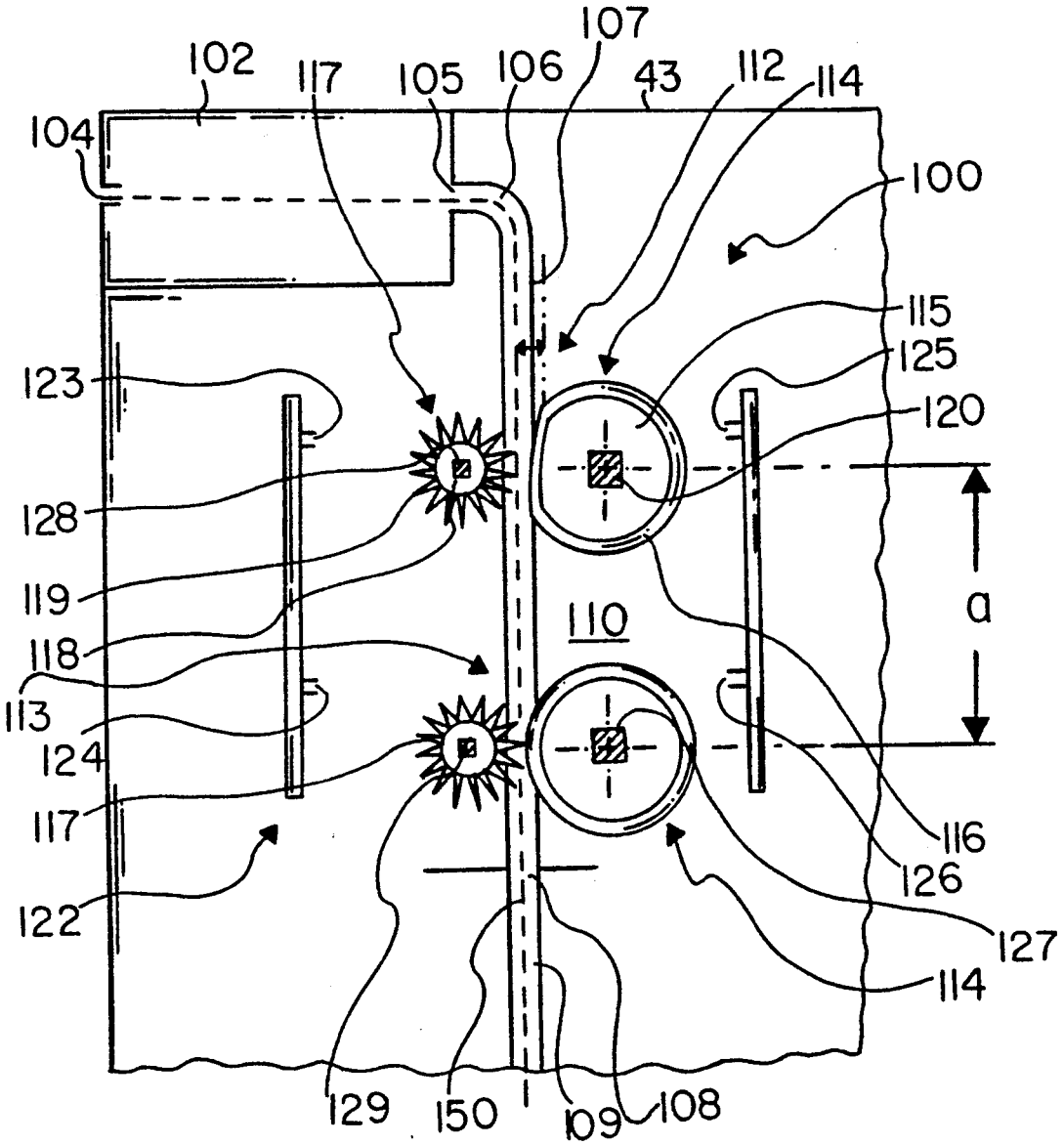

FIG. 1 shows a diagrammatic view of an arrangement of machines according to the invention with a central cashing-up system, FIG. 2 shows a front view of a further development of an arrangement of machines with a money changing unit, FIG. 3 shows a diagrammatic detailed view of a machine in the arrangements according to FIGS. 1 and 2, FIGS. 4 to 9 show a diagrammatic representations of further embodiments of arrangements with money changing units FIG. 10 shows a diagrammatic side view of a device for preventing withdrawal of banknotes in the money changing unit, FIG. 11 shows a diagrammatic view from the top of the bank note withdrawal lock of the device according to FIG. 10

Figure 13:
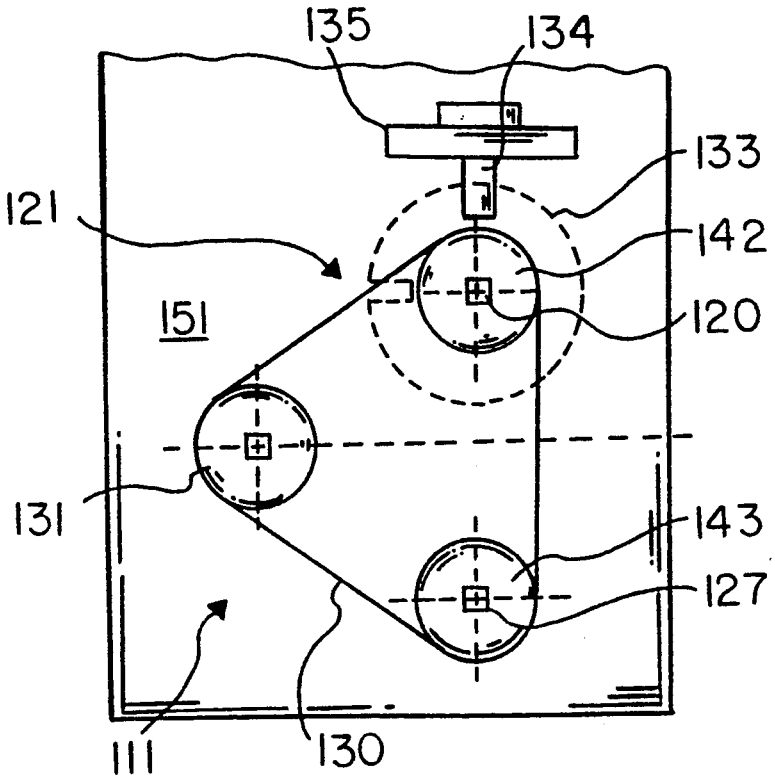
Figure 14:
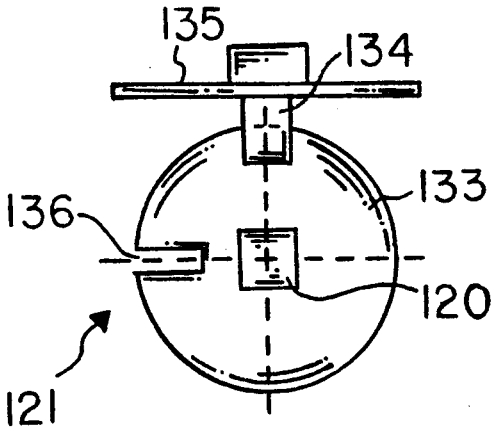
Figure 15:
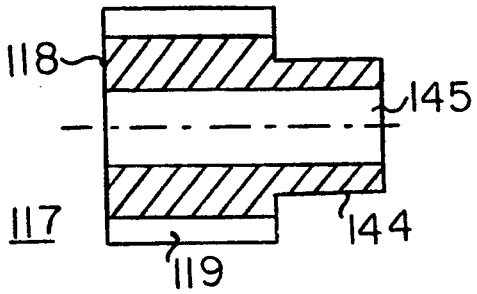
Figure 16:
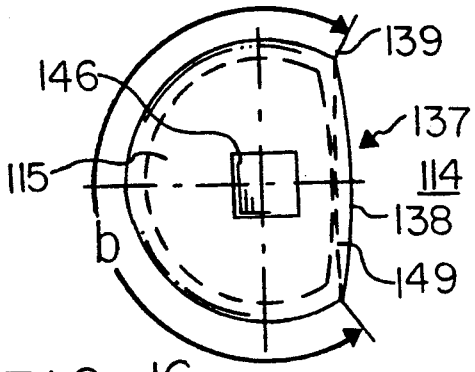
Figure 18:
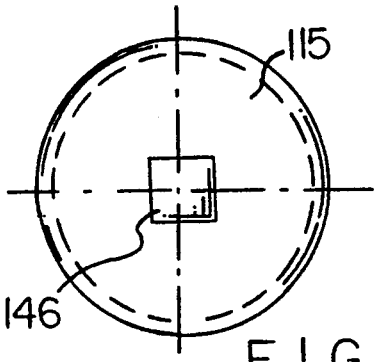
Figure 17:
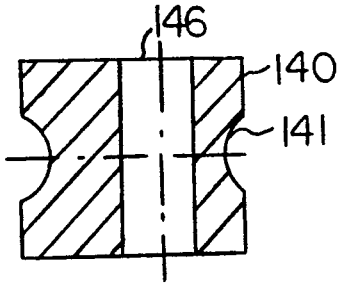
Figure 19:
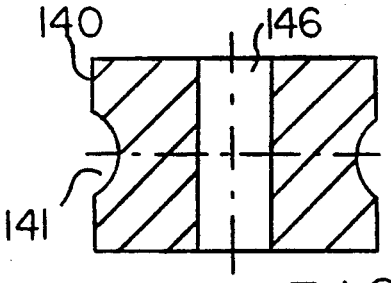
Figure 20:
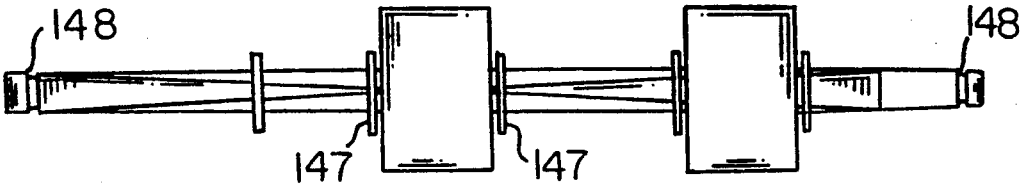
Figure 21:
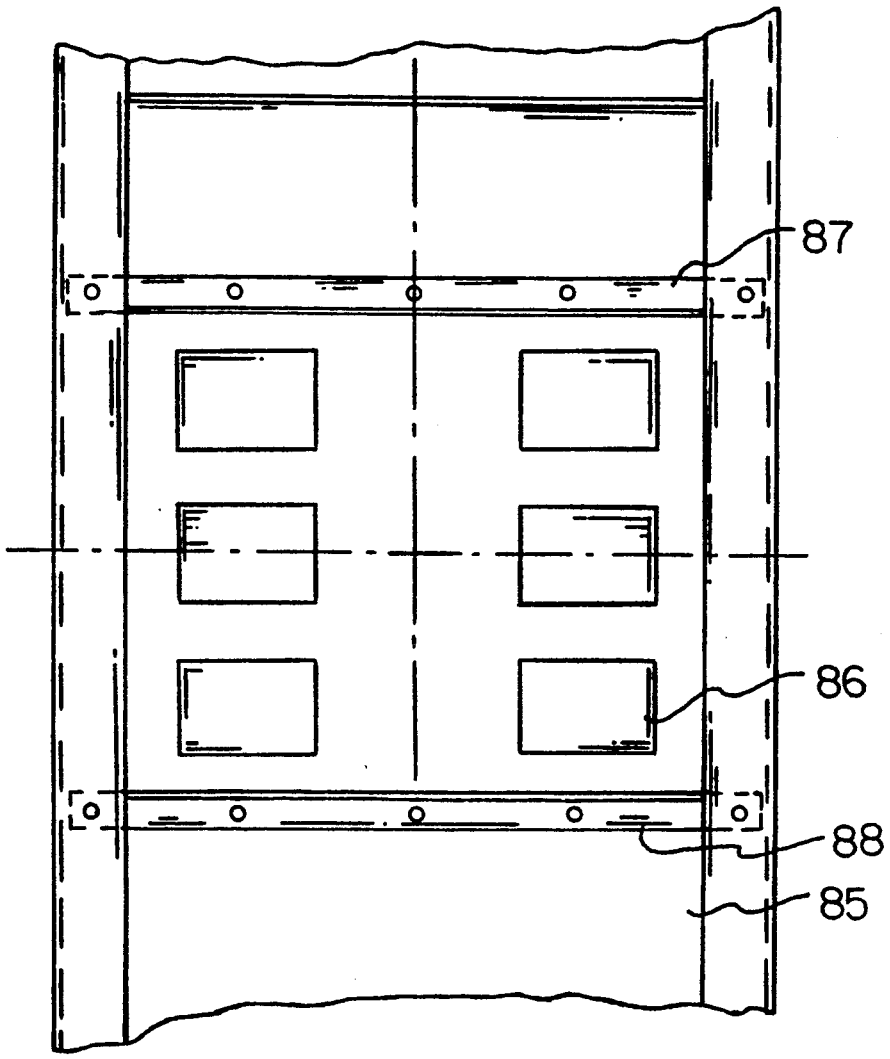
Figure 22:
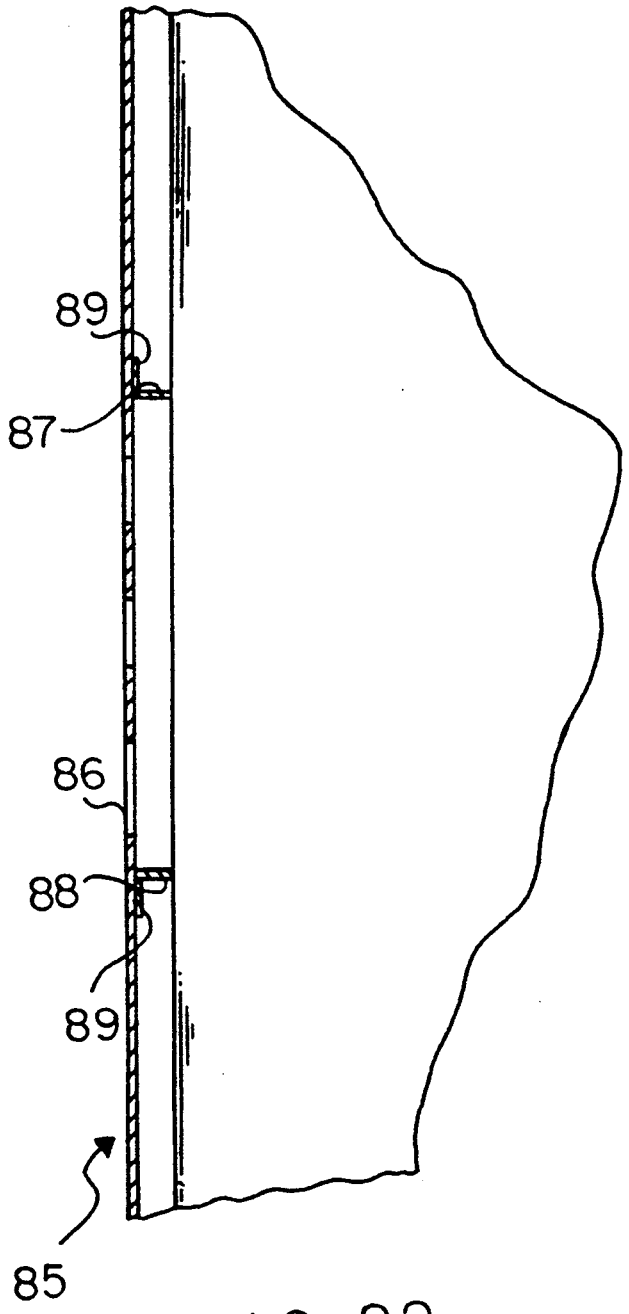
Figure 23:
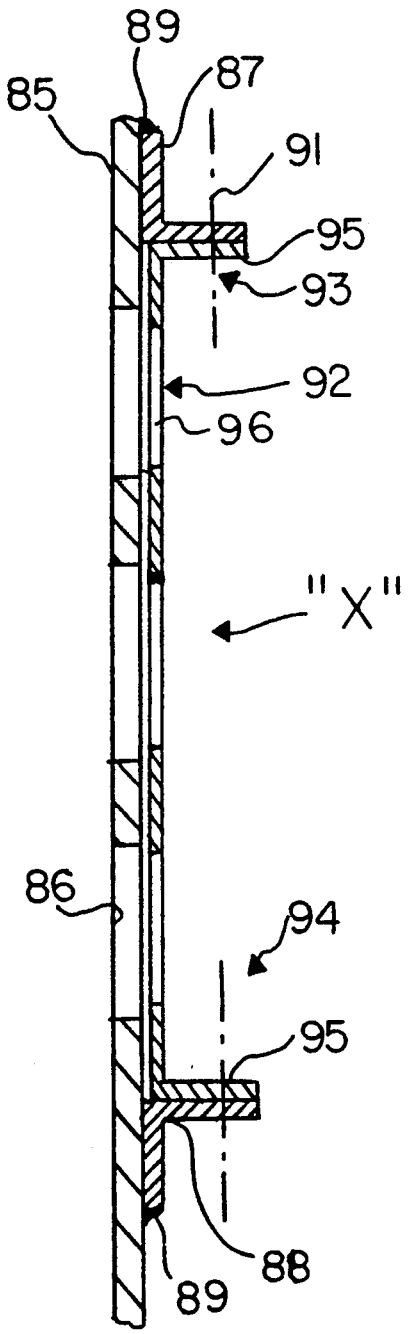
Figure 24:
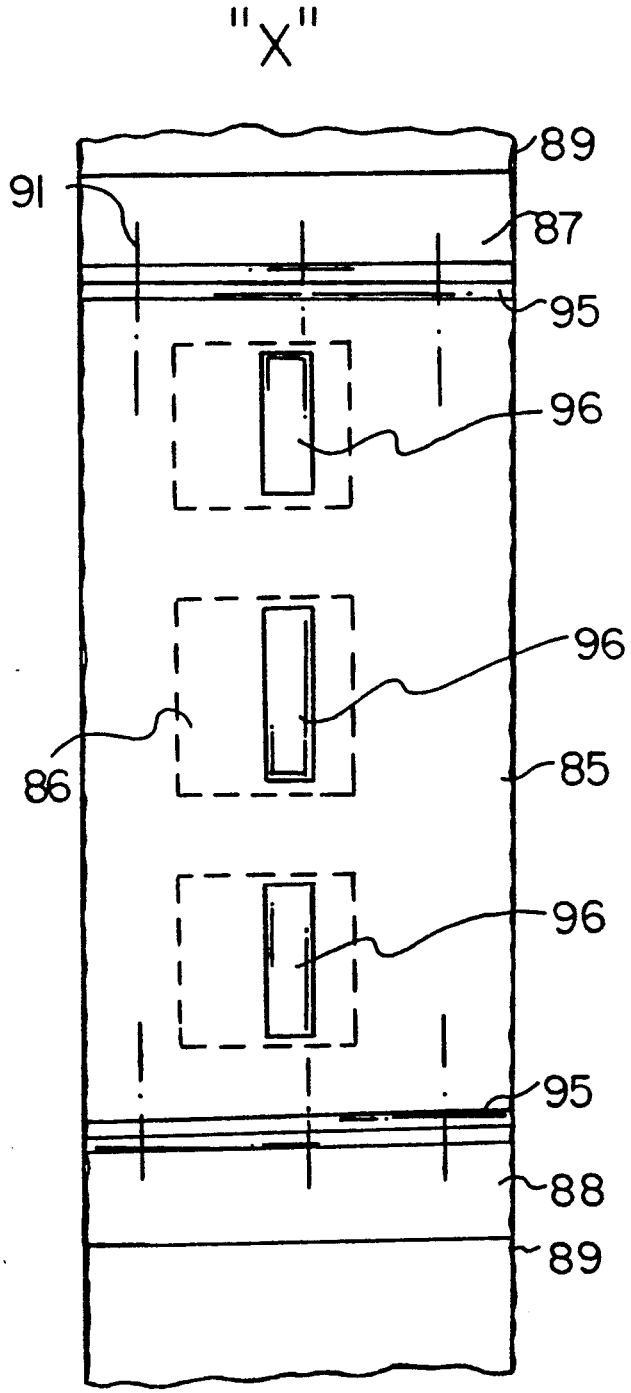

FIG. 12 shows the banknote withdrawal lock in a diagrammatic view from the front in direction A—A, FIG. 13 shows a diagrammatic side view of the drive of the transport rollers of the banknote withdrawal lock, FIG. 14 shows a diagrammatic side view of a disk cam for the light-optical scanner, FIG. 15 shows a side view in section of a transport roller of the banknote withdrawal lock designed as a counterpressure roller, FIGS. 16 and 17 show a side view and a plan view in section of a transport roller of the banknote withdrawal lock designed as a draw-in roller, FIGS. 18 and 19 show a side view and a plan view in section of a further development of a transport roller of the banknote withdrawal lock designed as a drawing roller, FIG. 20 shows a side view of a spindle with draw-in rollers according to FIG. 15, FIG. 21 shows a view of the rear wall of a money changing unit, FIG. 22 shows a side view of the rear wall according to FIG. 21, FIG. 23 shows a section of the rear wall in an enlarged representation, FIG. 24 shows a view of the rear wall according to FIG. 23 in the direction "X"

Figure 25:
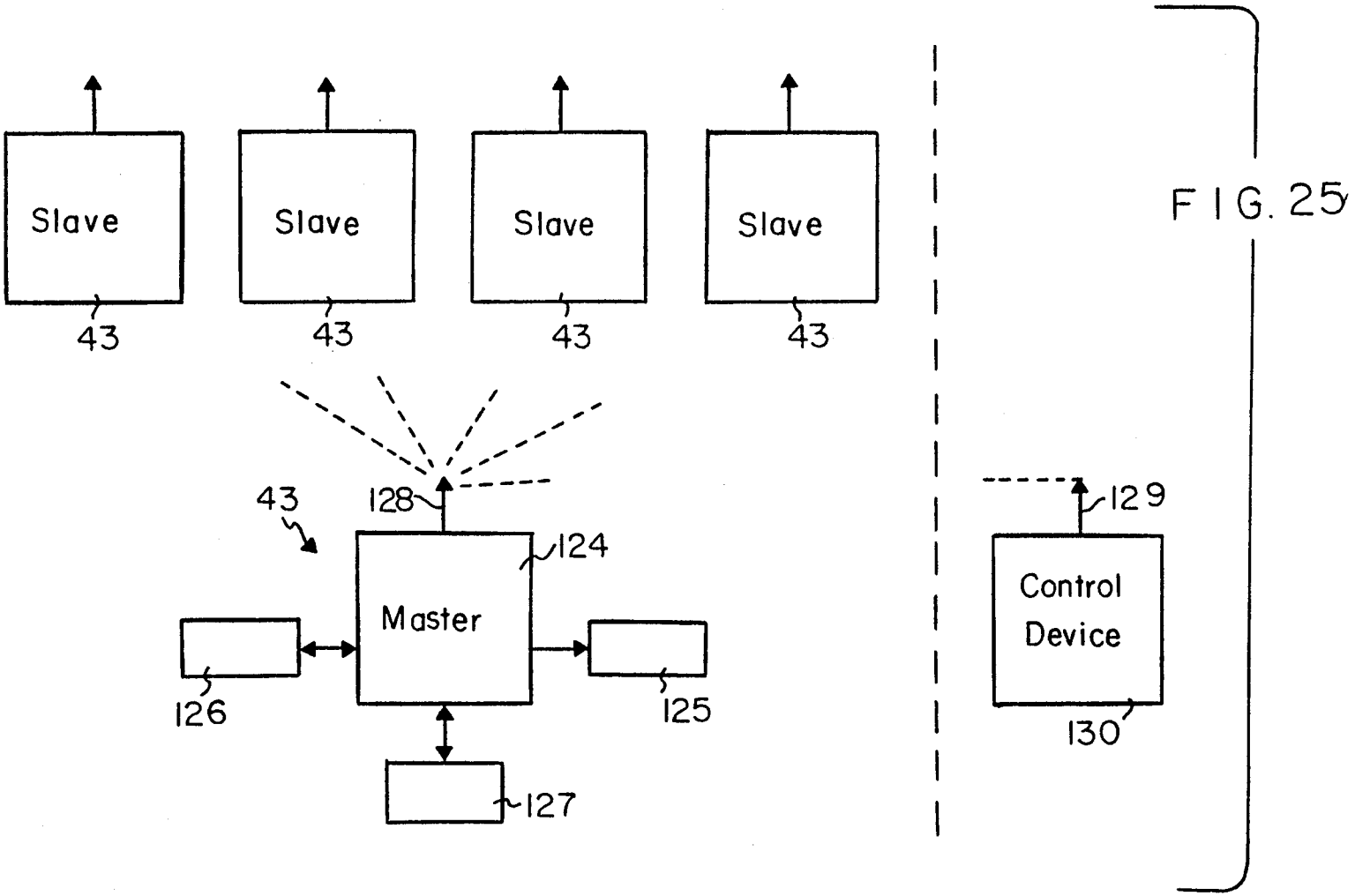
Figure 26:
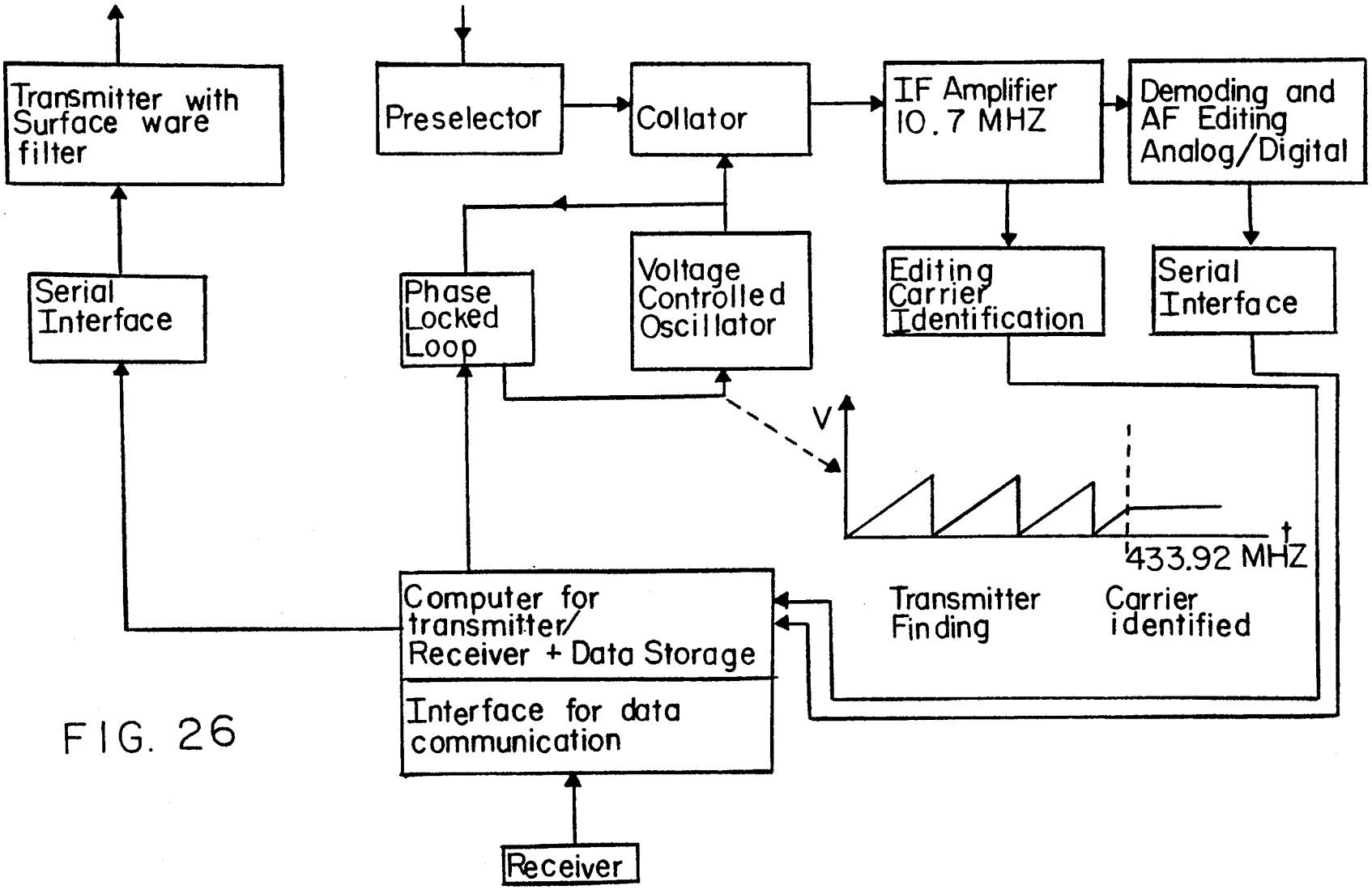

FIGS. 25 and 26 show details of the data transfer arrangement.

A particularly advantageous development of compact arrangements 39, 40 of machines is represented in FIGS. 1 and 2, in which machine groups 41, 42 are shown. The machine group 41 consists of three machines 2, 3, 4, a money changing machine 43 and three further machines 5 (FIG. 1). The machine group 42 consists of three machines 2, 3, 4 and a money changing machine 43 (FIG. 2). The money changing machine 43 is used for exchanging banknotes for coins.

The money changing machine 43 and the machines 2, 3, 4, 5 are arranged in a cabinet-type equipment mounting 44, visually forming a single unit. The money changing machine 43 is expediently located in a strongbox-type security container. A coin strongbox is provided in the base 45 of the equipment mounting 44 under the money changing machine 43 (FIG. 1). It is however also possible to arrange the coin strongbox 51 somewhere else on the base 45 (FIG. 2). The money changing machine 43 and the machines 2, 3, 4, 5 are fastened to a supporting wall 46 connected to the base 45. It is also possible to fasten the money changing device 43 and the machine 2, 3, 4, 5 in each case independently to a rack-like housing frame 97. Such a housing frame 97 is indicated in FIG. 2 by dashed lines. Each housing frame 97 with machine 2, 3, 4, 5 or money changing machine 43 then forms a machine module 90 of the respective arrangement of machines. The function of the arrangement 39 is like that of the arrangement 40 with the machine group 42, which is described more fully below. In the machine group 42 according to FIG. 2, the coin strongbox 51 is arranged offset with respect to the money changing machine 43. Each machine 2, 3, 4 has a coin slot (not shown in detail) with a coin tester, device cash counter as well as coin stacking chutes with a coin payout device and a payout tray 50. The coin payout device is activated by a corresponding game win. Coins inserted into machines 2, 3, 4, are passed unsorted into coin containers in the machines 2, 3, 4. There is preferably located behind each machine 2, 3, 4 a sorting and counting device 47 which is connected to the coin containers and which has in each case two coin outputs 48, 49. The coin output 48 is connected by means of a coin channel 52 to the coin input 56 of a hopper 54 arranged in the money changing machine 43. The coin output 49 is connected by means of a further coin channel 53 to the coin strongbox 51. On the coin output side, there is associated with the hopper 54 a coin container 55, the coin output devices of which can be controlled by the banknote changing device 16. The banknote changing device 16 has a banknote reader 62 which can be designed by appropriate programming to read various banknotes. The banknote reader 62 of the money changing device 16 can perform a fault-free banknote check by means of suitable spectral analysis, so that a high degree of security against forgeries is provided. Following the banknote reader 62 is a device 101 (not shown in detail) for preventing the withdrawal of banknotes, which is described more fully further below. It is expedient to design the banknote collecting container 31 as a box-like container which can be removed from the money changing machine 43. It is furthermore possible to connect a banknote stacker in front of the banknote collecting container 31, so that the banknotes are packed into bundles according to their value and introduced into the banknote collecting container 31.

By means of the described arrangements 39, 40, it is possible to optimize the cashing up and money collection for the machines 2, 3, 4 and to facilitate playing for the user by virtue of simplified banknote changing. Before starting up, the coin stacking chutes of the machines 2, 3, 4, 5 are filled up with the required amount of coins. The amount of coins payed out for wins is recorded by the payout counter of the coin output devices of the respective machines 2, 3, 4, 5. During play, further coins arising in the respective machines 2, 3, 4, 5 are sorted by means of the sorting and counting devices 47 to the extent that a preferred type of coin is fed via the respective coin channel 52 to the money changing machine 43. As a rule, the preferred type of coin will be the coin having the highest value. As a consequence of this, the player is required to play the further games with higher stakes when banknotes are changed. Further unsorted coins arising in the coin collecting container 58 (FIG. 3) of the machines 2, 3, 4, 5 remain unsorted and are fed via the coin channel 53 to the coin strongbox 51. It is possible to design the sorting and counting devices 47 in connection with the coin changing machine 43 in such a manner that when the set filling level of the money changing machine 43 is reached with the preferred type of coin, further coins of the preferred type of coin arising in the machines 2, 3, 4, 5 are likewise fed to the coin strongbox 51. The hopper 54 of the money changing machine 43 is automatically filled up by playing on the machines 2, 3, 4, 5. In this arrangement, the money changing device 43 can be designed so that it is also possible, if required, to fill up the hopper 54 manually from the outside, without it being necessary to open the coin collecting area of the hopper 54.

It is possible to call up and prepare the takings of each machine 2, 3, 4, 5 centrally. This achieves considerable cost and time savings during money collection and money handling.

FIG. 3 diagrammatically shows a diagrammatic detailed view of the machines 2, 3, 4, and 5. These machines are further simplified since no coin stacking chutes are required. Both the coins inserted into the machines 2, 3, 4, 5 during starting up and coins inserted during playing via the coin slot 6 are forwarded unsorted into a coin collecting container 58 of each machine 2, 3, 4, 5. At the front side 57 thereof, there is a coin output 8 of the payout device with a payout tray 50. The coin output 8 is connected to the coin collecting container 58 in the machines 2, 3, 4, 5. Located before the coin output 8 is a coin tester 59 which is connected to the payout counter 63 of the coin output device 61. The coin output device 61 is also connected to the sorting and counting device 47, as is represented diagrammatically in FIG. 3. By means of the sorting and counting device 47, the unsorted coins from the coin collecting container 58 are fed to the coin output 8, the amounts of the coins paid out being added up by the coin tester 59 of the payout counter 63. Once the predetermined payout amount has been reached, the coin output is interrupted. It is possible to set the coin output device 61 in such a manner that preferably certain types of coin are paid out. This makes it possible to relieve the coin collecting container 58 of low-value coins. On the other hand, when the player wins he receives a large number of low-value coins, which will frequently lead him to get rid of these coins by carrying on playing.

Figure 4:
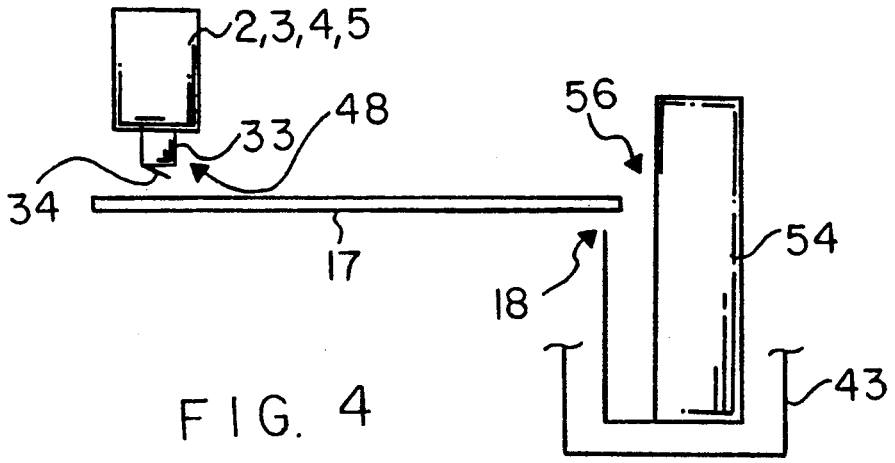

FIG. 4 diagrammatically shows a further development of an arrangement of machines 2, 3, 4, 5 with a money changing machine 43. Arranged at the coin output 48 of a machine 2 there is a temporary coin store 33 which has an opening flap 34 on the bottom side. The output of the temporary coin store 33 is associated with a coin conveying device 17. The conveying-side end section 18 of the coin conveying device 17 is led up to the coin input 56 of a hopper 54 of a money changing machine 43. The coin output devices of the hopper 54 can be controlled by the banknote changing device (not shown in detail) of the money changing machine 43.

Figure 5:
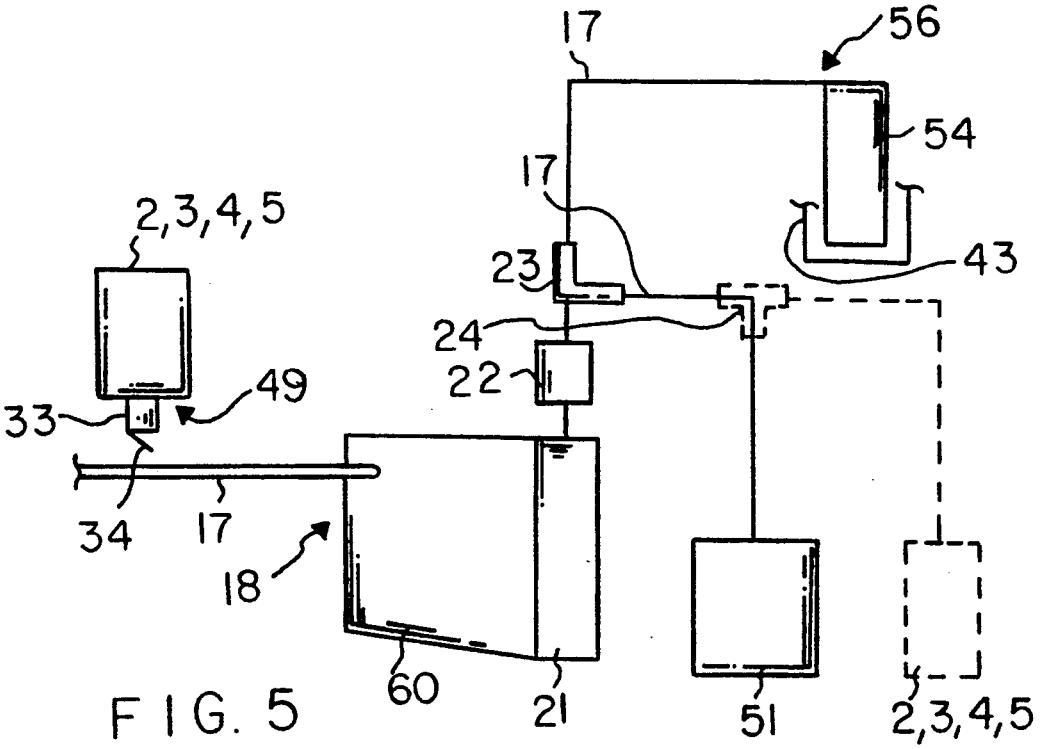

As illustrated diagrammatically in FIG. 5, it is also possible to provide coin outputs 49 on the machines 2, 3, 4, 5 for discharging unsorted coins. Here, too, it is possible to assign each coin output 49 a temporary coin store 33 with an opening flap 34 on its bottomside. From the temporary coin store 33, the unsorted coins pass on to a coin conveying device 17, the conveying-side end section 18 of which is associated with a central coin receptacle 60. The coin receptacle 60 may be designed as a coin strongbox 51. In the embodiment illustrated in the drawing, there is arranged in the coin receptacle 60 a hopper 21 which has a coin tester 22 on the coin output side. The coin tester 22 is connected in the coin conveying direction to a coin gate 23. By virtue of the action of the coin tester 22, coins of a preferred type of coin are fed by means of the coin gate 23 to the coin input 56 of the hopper 54 in the money changing machine 43. Remaining unsorted coins pass into the coin strongbox 51. A coin conveying device 17 is provided for transporting the corresponding coins between the coin gate 23 and the coin input 56. A coin conveying device 17 is likewise arranged between the coin gate 23 and the coin strongbox 51. It is possible to use coin channels as a coin conveying device 17 when it is possible for the coins to reach their destination by virtue of the incline of the coin channels as a result of gravity. It is also possible to feed unsorted coins back via a further coin gate 24 alternatively to the machines 2, 3, 4, 5 again instead of to the coin strongbox 51, as is indicated in FIG. 5 with dashed lines.

FIG. 6 shows a decentralized arrangement for coin handling. It is possible to arrange in each machine 2, 3, 4, 5 a hopper 28, at the coin output 29 of which a coin tester 22 with a coin gate 23 is designed. The coin gate 23 is connected to the associated coin output device 61 at the coin output 8 of the payout tray 50 and to a sorting and counting device 47. The hoppers 28 are each arranged in a coin area 35, at the top section of which a coin inlet opening 36 is provided. The coin inlet opening 36 is connected to a coin conveying device 17. The coin conveying device 17 is connected on the coin input side to the coin gate 23 associated with the hopper 21 in the coin receptacle 60. The coin output device 61 is connected to coin stacking chutes 7, from which coins pass for paying out through the coin output 8 into the payout tray 50.

FIG. 7 diagrammatically shows a machine 2, 3, 4, 5 which likewise has a hopper 28 in a coin area 35. The coin output 29 of the hopper 28 is, like in FIG. 6, connected via a coin tester 22 and a coin gate 23 to coin stacking chutes 7, which can be filled up via the coin gate 23 with the coins required in each case. Win payouts are drawn off from the coin stacking chutes 7. The coin area 35 likewise has a coin inlet opening 36, which can be closed by means of a flap 38. The position of the flap 38 is controlled by means of a coin output device 61, which also activates the hopper 21 in the central coin receptacle 60.

It is also possible to dispense with the coin stacking chutes 7 and to pay out wins directly with the aid of the hopper 28. In this case, the hopper 21 in the coin receptacle 60, as well as the position of the flap 38, is controlled as a function of control pulses of the win determining device of the respective machine 2, 3, 4, 5.

The aforementioned coin conveying devices 17 may be designed as coin chutes, belt conveyors, chain conveyors, pocket conveyors, pneumatic conveyors or magnetic conveyors. These conveyors permit horizontal as well as upward and downward inclined, and if necessary vertical, transport of the coins to be conveyed. This makes it possible to provide comparatively large arrangements of machines 2, 3, 4, 5 even in geometrically mutually offset position.

Figure 8:
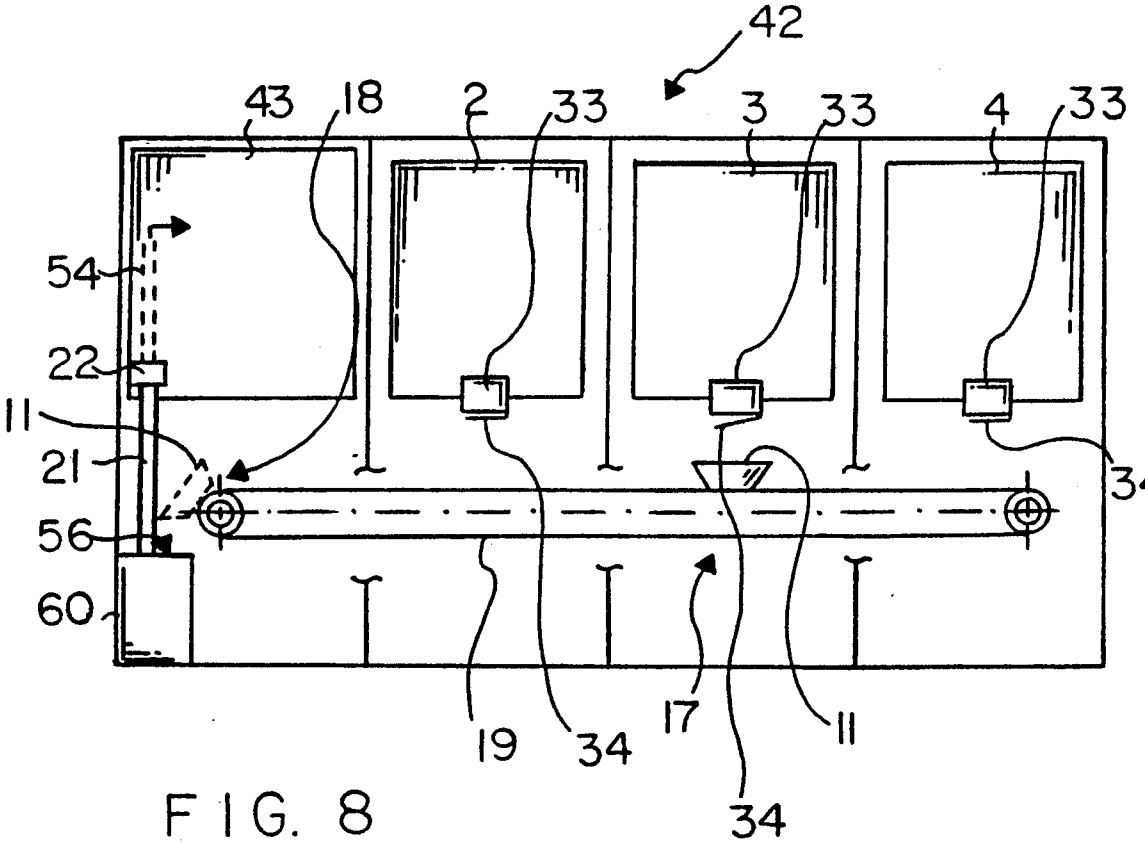

FIGS. 8 and 9 illustrate a machine group 42 with a money changing machine 43, in which the coin conveying device 17 is designed as a chain conveyor 19 for the serial handling of amounts of money. A temporary coin store 33 with an opening flap 34 is provided on each machine 2, 3, 4. The chain conveyor 19 is reversible with respect to the feed direction, and has a coin receiving dish 11. Each temporary coin store 33 of the machines 2, 3, 4 is emptied separately into the coin receiving dish 11. This is then transported by the chain conveyor 19 to the money changing machine 43 and emptied through a coin input 56 into a central coin receptacle 60. A hopper 21 conveys the quantity of coins through a coin tester 22. The quantity of coins received by the respective machines 2, 3, 4 is registered and the coins are fed via coin gates to further hoppers 54. By means of these hoppers 54, the coins are separated according to value and fed either back to the money cycle system or to a coin strongbox 51. This arrangement makes it possible to connect a large number of spatially remote machines 2, 3, 4 to a money changing machine, it being possible to register the coin revenue of each machine 2, 3, 4 separately.

FIG. 10 diagrammatically represents a section of a money changing machine 43 with the device 101 for preventing the withdrawal of banknotes. A banknote can be inserted through an insertion slit 104 into the testing device 102. After having been found to be satisfactory, the banknote is forwarded via the banknote outlet opening 105 into an input funnel 106, and from there is guided into the through-channel 107. The banknote withdrawal lock 110 is arranged in the through-channel 107. Said withdrawal lock consists of pairs of draw-in rollers 114 and counterpressure rollers 117 which are in effective engagement with one another. The banknote withdrawal lock 110 is controlled by means of a light-optical scanner 122.

In the input region 112 of the through-channel 107 there are provided on a spindle 128 two counterpressure rollers 117 which are both designed as a toothed disk 118. The teeth 119 are arranged on the periphery directed radially outward. Each counterpressure roller 117 is associated with a draw-in roller 114 which are mounted on a spindle 120. The draw-in rollers 114 consist of a disk-shaped supporting body 115, on the outer periphery of which in each case one resilient pressureabsorbing ring 116 is arranged. The teeth 119 of the counterpressure rollers 117 interact with the pressureabsorbing rings 116. In the input region 112, there is furthermore provided on one side of the through-channel 107 a diode 123 which is associated on the other side of the through-channel 107 with a sensor 125 of the lightoptical scanner 122.

In the output region 113 of the through-channel 107 there are counterpressure rollers 117 and draw-in rollers 114 likewise mounted on spindlers 129 and 127 respectively. In the banknote conveying direction in front of the counterpressure rollers 117 and the draw-in rollers 114, a diode 124 is provided on one side of the through-channel 107 and a sensor 126 of the light-optical scanner 122 is provided on the other side of the through-channel 107. Banknotes which have passed through the banknote withdrawal lock 110 are guided through an outlet opening 108 into a channel 109 that emerges into a banknote collecting container.

For driving the draw-in rollers 114, a belt drive 111 is provided as the driving device 151. Arranged in each case at the same end sections of the spindles 120, 127 are belt pulleys 142, 143, over which a drive belt 130 is guided which is connected to the drive belt pulley 131 of an electromotor 132 (FIGS. 11 and 13). Instead of a belt drive 111, it is also possible to provide an equivalent gear drive or chain drive. Furthermore, a control element 121 for the light-optical scanner 122 is provided on the spindle 120. This control element 121 consists of a disk cam 133 in which a slit 136 is formed. When the spindle 120 rotates the disk cam 133 is guided through a control switch 134 fastened to a bracket 135 of the device 101. When the slit 136 passes the control switch 134, the control pulse is triggered (FIGS. 13 and 14).

FIG. 15 shows an embodiment of the counterpressure rollers 117. These are of integral design and consist of a sleeve-shaped basic body 144 in which a spindles 120, 127. The toothed disk 118 with the teeth 119 is formed on one side section of the basic body 144.

Two embodiments of draw-in rollers 114 are represented in FIGS. 16 to 19. Each draw-in roller consists of a disk-shaped supporting body 115 with the pressure-absorbing ring 116 arranged on the periphery. The latter is preferably a ring of circular cross-section made of rubber or plastic and is mounted in the grooves 141 formed on the peripheries 140 of the disk-shaped supporting body 115. Each disk-shaped supporting body 115 has a central breakthrough 146 through which the spindles 120 and 127 respectively can be passed.

The draw-in rollers 114 to be arranged in the output region 113 are designed to be circular (FIGS. 18 and 19). The draw-in rollers 114 to be provided in the input region 112 of the through-channel 107 have on their periphery a flattened segment section 137 (FIG. 16). The segment section 137 is designed as a circular segment 138 with an enlarged diameter with respect to the diameter of the supporting body 115. The transition sections 139 between the segment section 137 and the supporting body 115 are in each case rounded. The remaining circular partial periphery b of the upper draw-in rollers 114 is greater than the spindle distance a between the spindles 120, 127 (FIGS. 10 and 16). As a result, it is already ensured that a banknote is gripped securely in the region of the lower draw-in rollers 114 when the flattened segment section 137 turns out again from the region of segment section 137 turns out again from the region of the upper counterpressure roller 117. In the idle position, the segment sections 137 are in a generally vertical position facing the counterpressure rollers 117. When a banknote is inserted into the through-channel 107, the banknote withdrawal lock 110 is activated. By means of the belt drive 111, the spindle 120 is turned until the slit 136 of the disk cam 133 is arranged in the region of the control switch 134. The functioning of the belt drive 111 is tested here by means of the disk cam 133. In this position, the light-optical scanner 122 is in operation and the input rollers 114 associated with the input region 112 are directed in such a way that the segment sections 137 face the upper counterpressure rollers 117. In this arrangement, the chords 149 of the segment sections 137 are directed with such an oblique angle with respect to the longitudinal axis 150 of the through-channel 107 that a generating angle $\alpha$ widening towards the input funnel 106 is formed (FIG. 10). This is preferably approximately 15°. By means of this position of the upper draw-in rollers 114, the introduction of the banknote into the region between the upper draw-in rollers 114 and the counterpressure rollers 117 is facilitated. When the banknote reaches the input region 112 of the through-channel 107, the light-optical scanner 122 of the electromotor 132 is activated via the diode 123 and the sensor 125 so that the spindles 120, 127 with the draw-in rollers 114 rotate. As soon as the slit 136 passes through the control switch 134, this means that the second transition section 139 of the draw-in rollers 114 arranged in the input region 112 press the banknote inserted into the through-channel 107 against the upper counterpressure rollers 117. It is then no longer possible to withdraw the banknote since the section of the pressure-absorbing ring 116 located on the circular section of the disk-shaped supporting body 115 remains in engagement with the counterpressure rollers 117. When the rear end section of the banknote passes the lower diode 124, a control pulse which releases the return button is output via the sensor 126 of the light-optical scanner 122. It is then no longer possible to withdraw the banknote into the upper region of the through-channel 107, as soon as the banknote lies between the draw-in rollers 114 and the associated counterpressure rollers 117.

As illustrated in FIG. 20, the draw-in rollers 114, and analogously also the counterpressure rollers 117, are pushed on to spindles of matching design in each case and are prevented from sliding at the edge by means of spindle locking rings 147. Grooves 148 are provided in the spindles at the edge, which serve to mount spindles in the housing of the device 101.

In order to obtain greater flexibility when installing machine groups 41, 42, it is advantageous to form in the rear wall 85 of the money changing machine 43 in each case breakthroughs 86, through which the coin channels 52 of the machines 2, 3, 4, 5 can be passed. As illustrated in FIGS. 21 to 24, the breakthroughs 86 are arranged in the manner of a grid and are of rectangular design. In each case one L strap 87, 88 is fastened to the upper and lower boundary edges of the breakthrough arrangement. A cover plate 92 is fastened by means of screw connections 91 to the L straps 87, 88. The L straps 87, 88 can be connected, for example, by means of weld joins 89 to the rear wall 85. Formed in the cover plate 92 are breakthroughs 93 whose opening cross-sections are smaller than the breakthroughs 86. Each breakthrough 96 is associated with in each case one breakthrough 86. This design facilitates the mounting of machine groups 41, 42. Owing to the larger breakthroughs 86, the coin channels 52 can be led into the money changing machine 43. Following this the cover plate 92 is fastened to the rear wall 85. In this arrangement, each coin channel 52 then lies against the edge of in each case one breakthrough 96 so that the rear wall 85 is closed.

By means of the machine groups 41, 42 in conjunction with the capability of passing coin channels 52 through the rear wall 85 of the money changing machine 43, it is possible to create in a simple manner a wide variety of arrangements of coin-operated machines.

In conjunction with partitions and, if necessary, transverse partitions and wall projections formed on the partitions, a wide variety of ground plan configurations can be created for the arrangement of machine groups 41. With each of these arrangements 64 to 84, it us ensured that a player can play on a machine group unobserved by third parties and can make use of the money changing machine 43 likewise unobserved.

In the following the data transfer between change dispensers and coin operated machines by radio telegraphy will be described.

FIG. 25 shows the arrangement for monitoring and cashing up of change dispensers of different groups of gambling or vending machines in a diagrammatic view.

One money changing machine 43 being a change dispenser of one group of coin operated machines is defined as master device. The other money changing machines 43 respectively change dispensers are defind as slave devices. Radio communication is possible by transmitter/receiver 128. The master device 124 has interfaces for a modem 126, a computer 127 and a read out device 125. Furtheron there is a central device 130 for monitoring and cashing up having a transmitter/-receiver 129.

The position of the devices many changed as data tranfer by radio telegraphy is independend from the location of the single transmitter/receiver 128, 129. The data transfer is as follows. Only the master device 124 is able to issue orders.

The master device 124 orders the slave devices one after another to transmit datas to the master devices 124. The data transfers between slave devices and master device 124 happens in short periods cyclically. The datas stored in the master device 124 are permanent ready on call by the central device 130 for monitoring and cashing up. By this means there are several advantages. The time for calling actual datas shortens. If there is a defect on one slave device the last datas before the defect are stored at the master device 124. Peripherical machines may be connected to the master device 124. A read out device 125 is able to call off all datas of change dispensers and coin operated machines. A computer 127 may be used to process the datas or for loading new datas into the change dispensers for instance parities of currencies. A modem 126 may be useful for communication by wire to process data over long distances. Data transfer is made coded for security. It is possible to load the master device 124 only after a recall of the master device 124 to the central device 130 for monitoring and cashing up.

The radio equipment may be active on a frequency of e.g. 433,92 MHz with a tolerance of +200 kHz and −200 kHz with an output of the transmitter of less than 5 mW. The transmitter are stabilized by surface wave filters. The function stroke of the transmitter may be between +5 kHz and −5 kHz which is a narrow band. The rate of datas is about 1200 or 2400 band. The band width of the filter of the receiver is small and may be about 10 kHz. The tolerance of the transmitting frequency is relative large. Therefore it is an advantage to use superhet-scanner-receiver. These receivers scan a large area of receiving frequency untill the carrier signal is detected. Now the scanner stops to check whether datas being received are valid. If the datas are invalid the scanner starts again to avoid messages from a wrong carrier.

FIG. 26 shows the block diagram of the data transfer device of arrangement according to FIG. 25. The electronic device 131 of the master device 124 includes interfaces for a transmitter and a receiver. The control circuit 132 controls the electronic device 131.

We claim:

1. A method of monitoring, cashing up and collecting money from coin-operated machines, which are connected individually or in groups with change dispensers, at least one of the change dispensers being a master change dispenser and the remainder of the change dispensers being slave change dispensers, the method including the steps of transferring excess coins from the machines to the dispensers, feeding coins to coin strongboxes of the dispensers, and, within each dispenser, 1) feeding coins to a payout tray by a coin sorting device in accordance with a banknote to be changed, and 2) feeding inserted banknotes into a banknote collecting container, the method further comprising the steps of a) adding and storing the value of coins being fed by each coin sorting device, b) adding and storing the value of the banknotes fed into each change dispenser and accumulated in each banknote collecting container, c) transferring data representing the stored values of the banknotes and coins by a radio equipment from each slave change dispenser to the master change dispenser, d) transferring data from the master change dispenser to a central control device, the control device evaluating the data transferred to it and monitoring the operation of the change dispensers, and e) cashing up the change dispensers.

2. A method according to claim 1, wherein the master change dispenser records the data transferred to it by the slave change dispensers.

3. A method according to claim 2, wherein the data transfer between the master change dispenser and the slave change dispensers is performed in short, cyclic, time intervals.

4. A method according to claim 1, wherein within each change dispenser coins are fed to the payout tray as directed by the central control device.

5. A method according to claim 1, wherein unsorted coins are fed to the coin sorting device from a hopper.

6. A method according to claim 3, wherein the data transferred is coded.

7. A method according to claim 2, wherein the data transferred between the master change dispenser and the central control device is coded.

8. A method according to claim 7, wherin the master change dispenser receives a password as code before it transfers data.

9. A method according to claim 7, wherein the data transfer between the master change dispenser and the central control device is executed via a modem or by radio equipment.

10. A method as in claim 1, wherein said coin-operated machines are vending machines.

11. A method as in claim 1, wherein said coin-operated machines are gambling machines.

* * * * *